United States Patent [19]

Hashimoto et al.

[11] 4,431,301

[45] Feb. 14, 1984

[54] ELECTROSTATIC COPYING APPARATUS WITH MEANS FOR PREVENTING CONTAMINATION OF REVERSE SIDE OF COPYING MEDIUM

[75] Inventors: Shinichi Hashimoto, Fujisawa; Kunihiko Miura, Hiratsuka, both of Japan

[73] Assignee: Tokyo Shibaura Denki Kabushiki Kaisha, Kawasaki, Japan

[21] Appl. No.: 240,307

[22] Filed: Mar. 4, 1981

[30] Foreign Application Priority Data

| | | | |
|---|---|---|---|
| Mar. 12, 1980 | [JP] | Japan | 55-31282 |
| Mar. 12, 1980 | [JP] | Japan | 55-31283 |
| Mar. 12, 1980 | [JP] | Japan | 55-31284 |
| Mar. 12, 1980 | [JP] | Japan | 55-31285 |

[51] Int. Cl.[3] ..... G03G 15/00

[52] U.S. Cl. ..... 355/14 CH; 355/3 CH; 355/3 TR

[58] Field of Search ..... 355/3 TR, 3 SH, 14 SH, 355/14 CH, 14 R, 3 R, 3 CH

[56] References Cited

U.S. PATENT DOCUMENTS

| | | | |
|---|---|---|---|
| 3,751,155 | 8/1973 | Liechty | 355/125 |
| 3,751,156 | 8/1973 | Szostak et al. | 355/3 TR |
| 3,944,356 | 3/1976 | Hayne | 355/14 CH |
| 4,114,536 | 9/1978 | Kaneko et al. | 355/3 TR |
| 4,257,700 | 3/1981 | Tsuda et al. | 355/3 TR |
| 4,326,792 | 4/1982 | Landa | 355/3 TR |

FOREIGN PATENT DOCUMENTS

| | | |
|---|---|---|
| 2213975 | 10/1973 | Fed. Rep. of Germany . |
| 2507558 | 8/1975 | Fed. Rep. of Germany . |

*Primary Examiner*—R. L. Moses

*Attorney, Agent, or Firm*—Finnegan, Henderson, Farabow, Garrett & Dunner

[57] ABSTRACT

An electrostatic copying apparatus comprises a photosensitive body forming a toner image on the surface thereof, and a transfer device for transferring electrostatically the toner image formed on the surface of the drum to a copying paper. The transfer device includes a rotatable transfer roller which faces the surface of the photosensitive drum for selectively transferring at least two different sizes of the copying paper. The transfer device comprises a moving mechanism for driving the transfer roller for such a period as to feed the copying paper for a distance equal to the length thereof in the feeding direction, while keeping the copying paper in contact with the photosensitive drum. Additionally, apparatus is provided for forming a toner image on the surface of the drum corresponding in width to that of the copying paper being utilized.

1 Claim, 12 Drawing Figures

ELECTROSTATIC COPYING APPARATUS WITH MEANS FOR PREVENTING CONTAMINATION OF REVERSE SIDE OF COPYING MEDIUM

BACKGROUND OF THE INVENTION

The present invention relates to an electrostatic copying apparatus for electrostatically transferring an image formed on an image forming body to a copying medium and, more particularly, to an electrostatic copying apparatus with a transfer roller.

Recently, there has been proposed a transfer device with a transfer roller as a means for transferring a toner image formed on a surface of an image forming body such as a photosensitive layer of a photosensitive drum onto a copying medium such as a copying paper.

The transfer device is provided with a transfer roller which is rotatably disposed touchable to the outer peripheral surface of the photosensitive layer. A bias voltage is applied to the outer peripheral surface of the transfer roller. A copying paper being supplied is nipped between the outer periphery surfaces of the photosensitive layer and the transfer roller. At the paper nipping portion, a toner image formed on the photosensitive layer surface is electrostatically attracted from the photosensitive layer surface onto the paper under the applications of the bias voltage. In this way, the toner image is transferred onto the paper. The image transfer by means of the transfer roller is very effective for the electrostatic copying apparatus of the type in which a toner image has been formed temporally on the photosensitive layer before the execution of copying.

In the image transfer using the transfer roller, however, when a part of a toner image for a paper of large size is transferred to a paper of small size, the toner of the toner image portion formed on the area of the photosensitive layer which is other than the area defined by the small size paper directly adheres to the corresponding area on the outer peripheral surface of the transfer roller. In the next transfer stage using a large size paper, the toner left adhering to the outer peripheral surface of the transfer roller adheres to the reverse side of the large size paper to soil the reverse side of the paper.

SUMMARY OF THE INVENTION

It is an object of this invention to provide an electrostatic copying apparatus which can prevent a transfer roller from getting dirty with toner formed from that part of a toner image which cannot be transferred onto a copying medium and which can therefore prevent the copying medium from being stained with the toner.

According to an aspect of the present invention, there is provided an electrostatic copying apparatus having an image forming body forming a toner image on the surface thereof and a transfer device for transferring electrostatically the toner image formed on the surface of the image forming body to a copying medium, the transfer device having a rotatable transfer roller which faces the surface of the image forming body for selectively copying at least two different sizes of the copying medium, wherein the transfer device comprises a drive mechanism for driving the transfer roller for such a period as to feed the copying medium for a distance equal to the length thereof in the feeding direction, while keeping the copying medium in contact with the image forming body.

The present invention will be better understood after careful reading of the following description taken in connection with the accompanying drawings, in which:

DETAILED DESCRIPTION OF THE PREFERRED EMBODIMENTS

A first embodiment of an electrostatic copying apparatus according to the present invention will be described in detail referring to the accompanying drawings.

Figure 1:
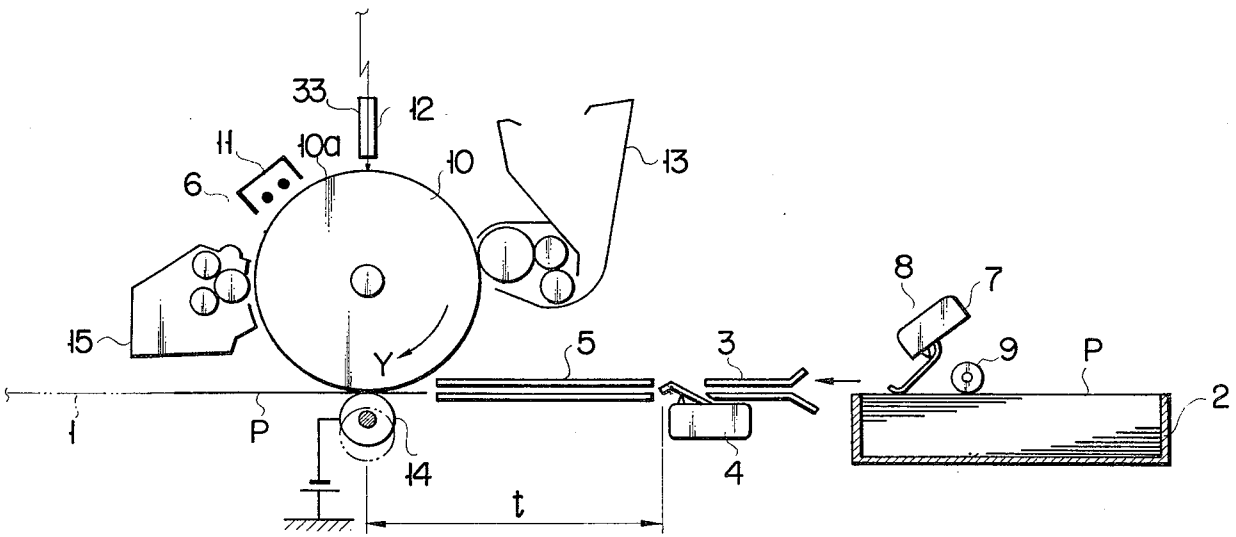
FIG. 1 is a side view of a main portion of a first embodiment of an electrostatic copying apparatus according to the present invention.

In FIG. 1, reference numeral 1 designates a paper transfer path of the electrostatic copying apparatus. Along the path 1 in the order of numbers from a start end of the copying apparatus, there are disposed a paper feed cassette 2 for containing a pile of copying papers P as the copying medium, a first paper guide 3, a paper length detecting switch 4, a second paper guide 5, a copying processing mechanism 6, a fixing device (not shown) and a tray for discharged papers (not shown). A plurality of detecting switches 7 are disposed at the start end of the paper transfer path and above the paper feed cassette 2. These detecting switches 7, arranged side by side in a direction orthogonal to the paper transfer path 1, constitute a paper width detecting means 8. A paper feed roller 9 is disposed touchable to the top of the pile of copying papers P.

The construction of the copying processing mechanism 6 will be described hereinafter.

Figure 4A:
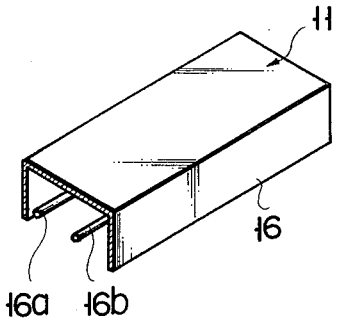
FIG. 4A is a perspective view of a charger used in copying apparatus shown in FIG. 1.
Figure 4B:
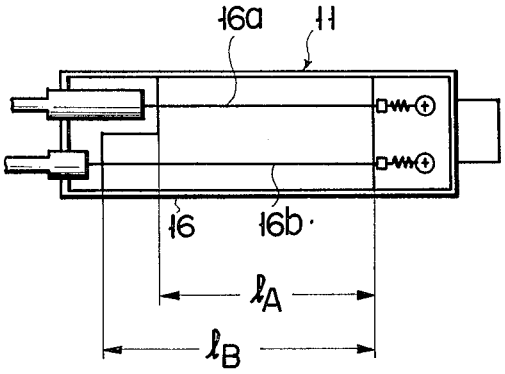
FIG. 4B is a bottom view of the charger shown in FIG. 4A.

A photosensitive drum 10 as the image forming body comprises a cylindrical body of aluminum as a base member of which the outer peripheral surface is coated with photosensitive material such as zinc oxide or the like. The photosensitive coated film forms a strong photosensitive layer 10*a* around the outer peripheral surface of the cylindrical body. The lower end of the outer periphery surface of the drum 10 is disposed in opposition to the transfer path 1. The photosensitive drum 10 is rotated, by means of an external drive means (not shown), in a direction the arrow (clockwise). Disposed around the periphery of the photosensitive drum 10 are, in the order of numerals or in the arrow direction, a charger 11, an image exposure device 12, a developing device 13, a transfer device 14, and a cleaner 15. Those periphery devices constitute the well known copying process mechanism. The charger 11 of those periphery devices has a construction as well illustrated in FIGS. 4A and 4B. As shown, two wires 16*a* and 16*b* for corona discharge with different lengths $l_A$ and $l_B$ are separately arranged in parallel fashion in a longitudinal direction of the charger body 16 within the charger body 16. The lengths $l_A$ and $l_B$ represent the widths of copying papers of A4 and B4 sizes, respectively. In accordance with the paper widh information of the detecting switch 7 in the paper width detecting means 8, the wire 16*a* or 16*b* is selected for its electrical energization. The charged width on the photosensitive layer 10*a* is switched in accordance with the paper width of A4 or B4, through the selection of the wire.

Figure 2:
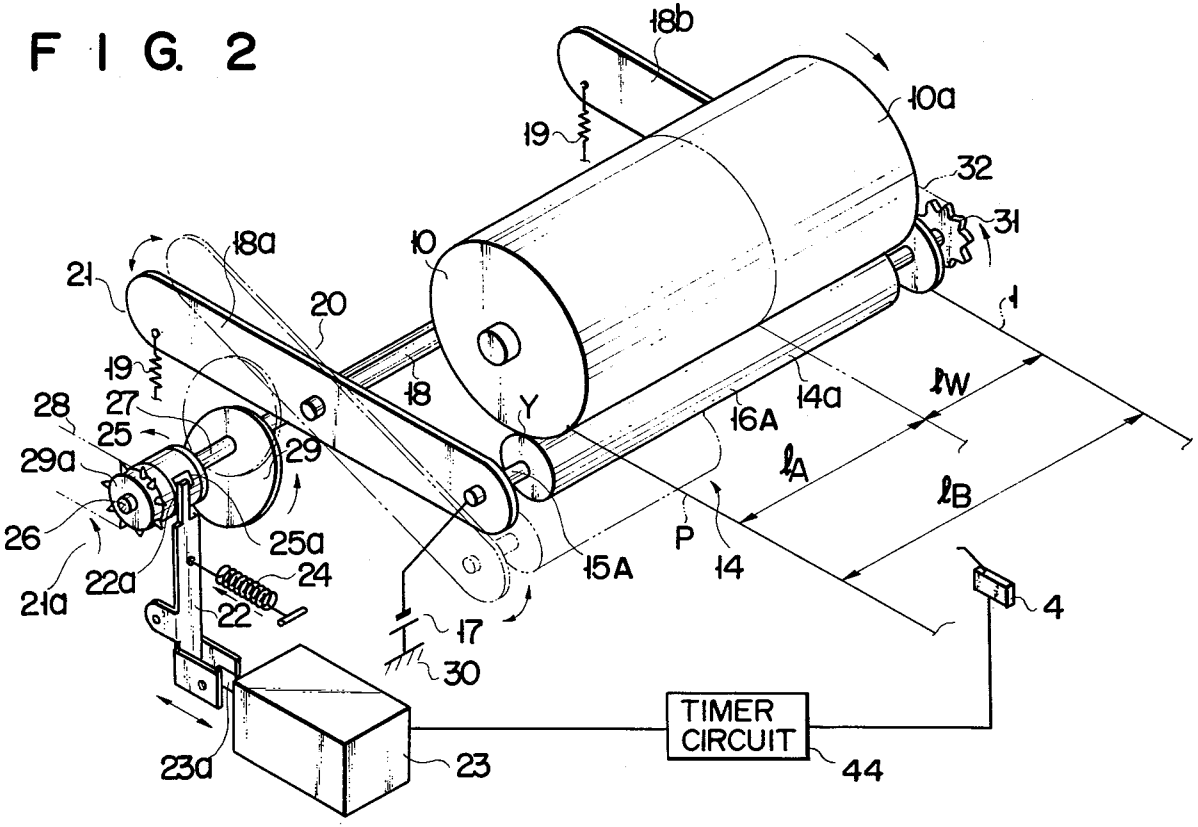
FIG. 2 is a perspective view of a transfer device used in the copying apparatus shown in FIG. 1.
Figure 3:
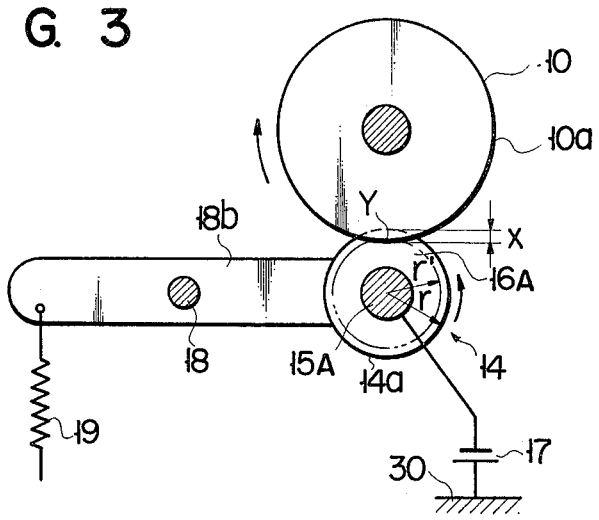
FIG. 3 is a side view of the transfer device shown in FIG. 2.

The transfer device 14 used in the copying processing mechanism 6 is shown in FIGS. 2 and 3.

The transfer device 14 is provided with a rotatable transfer roller 14*a*. The transfer roller 14*a* rotatably contacts the lower periphery portion of the photosensitive drum 10, with the paper transfer path 1 interposing therebetween.

When the transfer roller 14*a* is made to contact with the photosensitive layer 10*a*, the following requirements must be satisfied in order to improve the transfer efficiency:

(1) the bias voltage must be applied to the portion Y of the photosensitive layer 10*a* where the transfer roller 14*a* contacts the layer 10*a* through a copying paper;

(2) the bias voltage must be applied to as broad a portion of the layer 10*a* as possible; and (3) the drum 10*a* and roller 14*a* must be rotated at the same circumferential speed thereby to prevent toner from falling from the copying paper P and thus the picture from deteriorating.

Bearing the above requirements in mind, let us consider the transfer roller 14*a*.

The transfer roller 14*a* has a conductive, resilient tubular member 16A provided around a metal shaft 15. One end of the shaft 15A of the transfer roller 14*a* is coupled with a minus terminal of a DC power source 17 as a bias means. The DC power source 17 applies about −50 V to −1 KV, for example, appropriate for the transfer process over the periphery surface of the resilient member 16A. The plus terminal of the DC power source 17 is grounded. One end of the shaft 15A the transfer roller 14*a* is rotatably coupled with the one end of lever 18*a*; and the other end of the shaft 15A is similarly coupled to lever 18*b*. The levers 18*a* and 18*b* are rotatably interconnected at the centers with each other by means of a common support shaft 18. The other ends of the levers 18*a* and 18*b* are coupled with tension springs 19, respectively. The springs 19 urge the respective levers 18*a* and 18*b* about the shaft 18 as a fulcrum counterclockwise as viewed in the drawings. The levers 18*a* and 18*b*, the support shaft 18 and the spring 19 cooperatively constitute a driving mechanism 20 for moving the transfer roller 14*a* toward away from the photosensitive drum. Specifically, when the transfer roller 14*a* is in the transfer mode, it presses the resilient member 16A against the photosensitive drum 10 to make a depression on the rotatable contact portion Y of the resilient member 16A, thereby increasing the area of the bias voltage impression. The swing mechanism 20 is coupled with a cam clutch mechanism 21*a*. Mechanisms 20, 21*a* cooperate to construct a transfer roller swing means 21.

The cam clutch mechanism 21*a* will be described hereinafter. In the FIG. 2, reference numeral 22 designates a clutch operation arm rotatably supported at the center. The proximal end of the arm 22 is coupled with an actuator 23*a* of a solenoid 23. The distal end of the arm 22 is provided with a nail like operating part 22*a*. The solenoid 23 is coupled with the paper length detecting switch 4 and a timer circuit 44. In operation, the paper length detecting switch 4 detects the leading end of the transfer paper P. After t second, which is taken for the leading end of the paper P to travel from the detecting portion of the switch 4 to reach the rotatable contact portion Y of the photosensitive drum 10 with the transfer roller 14*a*, a detection signal which is delayed by the timer circuit 44 is inputted to the solenoid 23.

Upon receipt of the signal, the solenoid 23 is energized and immediately deenergized. The actuator 23*a* projects from the solenoid 23 and immediately retreates into the solenoid 23. As the actuator 23*a* moves back and forth in this manner, the arm 22 swings. Then, the copying paper travels and the trailing end of the transfer paper P is detected by the paper length detecting switch 4. After t second from the trailing end detection, the detection signal is inputted to the solenoid 23. By the input signal, the solenoid 23 is energized and immediately after the energization, it is deenergized. With the energization and deenergization, the actuator 23*a* advances and retreats the swing the arm 22. A compression spring 24 for arm restoration is connected to the arm 22, which urges the arm 22 in one direction. A clutch system to time the operation of the transfer roller 14*a*, through the arm 22 will be described hereinafter.

Reference numeral 25 designates a known semirotation clutch. A pair of depressions 25*a*, formed on the peripheral surface of the semirotation clutch 25, are distant from each other by 180° along the periphery of the clutch 25. In the semirotation clutch 25, the operation part 22*a* of the arm 22 is inserted into one of the depressions 25*a* at a predetermined position to stop the rotation of the main body of the clutch. As a result, the rotation of a drive shaft 26 is not transferred to a driven shaft 27. On the other hand, when the operating part 22*a* is removed from the depression 25*a*, the rotation of the clutch main body is allowed. Then, at the same position the operating part 22*a* is inserted into the other depression 25*a* of the clutch 25 to allow the rotation drive force of the drive shaft 26 to be transmitted to the driven shaft 27. As a result, the driven shaft 27 is rotated by 180°. The operation part 22*a* of the arm 22 is so arranged that it always contacts the peripheral surface of the clutch body surface and when the depression 25*a* reaches the given position where the operating part 22*a* is disposed, the operation part 22*a* drops into the depression 25*a*. The drive shaft 26 is coaxially and fixedly mounted to a sprocket 29*a* which is coupled with a drive source (not shown) by means of a chain 28.

A pair of circular cam plates 29 are eccentrically mounted to the driven shaft 27 of the semirotation clutch 25, being part from each other in parallel. These cam plates 29 are so arranged that, when the semirotation clutch 25 is at the time of no transmission of the drive force either the furthest part of the cam surface from the eccentric shaft or the closest part of each cam plate is disposed at the top portion as viewed in the vertical direction. The cam plates 29 are disposed below the lower surfaces of the levers 18*a* and 18*b*, while the cam surfaces of both the cam plates 29 engage with the lower surfaces of the levers 18*a* and 18*b*. In operation, when the furthest portion of the cam surface is positioned at the upper side, the levers 18*a* and 18*b* are rotated clockwise, while resisting the urging force of the spring 19, to retreat the transfer roller 14*a* from the surface of the photosensitive drum 10. When the closest portion of the cam surface is disposed on the upper side, the levers 18*a* and 18*b* engaging the closest parts of the cams are rotated counterclockwise according to the urging force of the spring 19 to make the transfer roller 14*a* contact with the surface of the photosensitive drum 10. Under a condition that the transfer roller 14*a* is rotatably in contact with the surface of the photosensitive drum 10, the cam surface may be in a separation from the lower surfaces of the levers 18*a* and 18*b*. According to the eccentricity of the cam surface, the levers 18*a* and 18*b* are rotatably moved to press the transfer roller 14*a* against the photosensitive drum 10*a* and to separate it from the drum. As a drive system for the transfer roller 14*a*, a sprocket 31 is fixedly mounted to the end of the shaft 15A, and the sprocket 31 and a drive source (not shown) are coupled with each other by means of a chain 32. During the course of operation of the copying apparatus, the transfer roller 14*a* normally is rotated by the drive system.

The peripheral speed of the rotation of the transfer roller 14*a* is equal to that of the resilient member with a distorted radius r' reduced by an amount x of distortion due to the pressure, as shown in FIG. 3. In other words, the peripheral speed of the transfer roller 14*a* is faster than the peripheral speed of the photosensitive drum 10 by the amount x of distortion, or the difference between the distorted radius r' of the resilient member 16A at the time of the pressure contact of the transfer roller 14*a* and the radius r of the resilient member 16A at the time of non-contact of the roller 14*a*. With the peripheral speed adjustment, the peripheral speed of the photosensitive drum at the time of the pressure contact is coincident with that of the transfer roller 14*a*.

With references to the aforementioned figures, explanation will be given about a case where the copy is made by using the electrostatic copying apparatus.

The paper supply cassette 2 containing a pile of papers P of a small size, for example, an A4 size with a length $L_A$ (which extends in the transfer direction of the paper) and a width $l_A$ (which extends in the direction orthogonal to the paper transfer direction), is loaded into the main body (not shown) of the copying apparatus. Then, a document is placed on a document table (not shown); an operating section (not shown) is operated to set the copy size to a desired size, for example, A4 size; and a copy start switch (not shown) is operated. Upon the turning on the start switch, the copying process mechanism 6, the paper feed system, and the paper discharging system are in the operation mode.

The document on the document table is exposed in the scanning manner by the exposure device 12. An image on the document is led to the photosensitive layer 10*a* by the optical fiber lens 33. The charger 11 receives the paper width detecting information of the A4 paper outputted from the detecting switch 7 to electrically energize the shorter wire 16*a* and to charge the photosensitive layer 10*a* with the width $l_A$ of the A4 size. With the rotation of the photosensitive drum 10, an image is projected, through the optical fiber lens 33, on the photosensitive layer 10*a* thus charged, thereby to form an electrostatic latent image 34 corresponding to the image of the document on the photosensitive layer 10*a*. The electrostatic latent image 34 is changed into an visual image, which is led to the transfer device 14.

Note here that the portion of the copying paper P of the B4 size which is larger than the copying paper P of the A4 size in the width of the photosensitive layer 10*a*, that is to say, the width portion of the photosensitive layer 10*a* corresponding to the width $l_W$ ($=l_B-l_A$), is not charged and has no toner thereon. Hence, toner is never attached to the portion of the transfer roller 14*a* in opposition to the portion (extending over the width of $l_W$) of the photosensitive layer 10*a*.

In the paper feed system, the paper feed roller 9 operates to take out the copying paper P of the A4 size sheet by sheet from the paper feed cassette 2. The copying paper P taken out is transferred to the paper length detecting switch 4 along the paper transfer path 1. When the switch 4 detects the leading end of the paper P, the detecting signal is applied to the timer circuit 44. After t second taken for the leading end of the paper P to travel from the detecting portion by the switch 4 to reach the rotatable contact portion Y on the photosensitive drum 10, the timer circuit 44 produces a signal for transfer to the solenoid 23. Upon receipt of the signal, the solenoid 23 drives the transfer roller 14*a* to make it rotatably contact with the photosensitive layer 10*a*.

Figure 5:
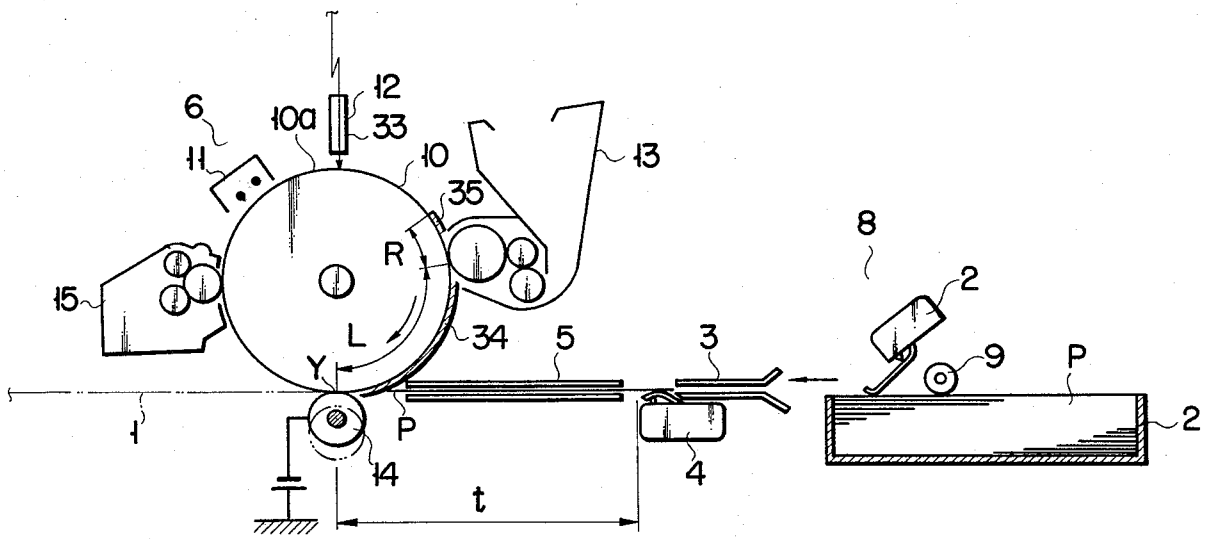
FIG. 5 is a side view useful in explaining the operation of the copying apparatus shown in FIG. 1.
Figure 6:
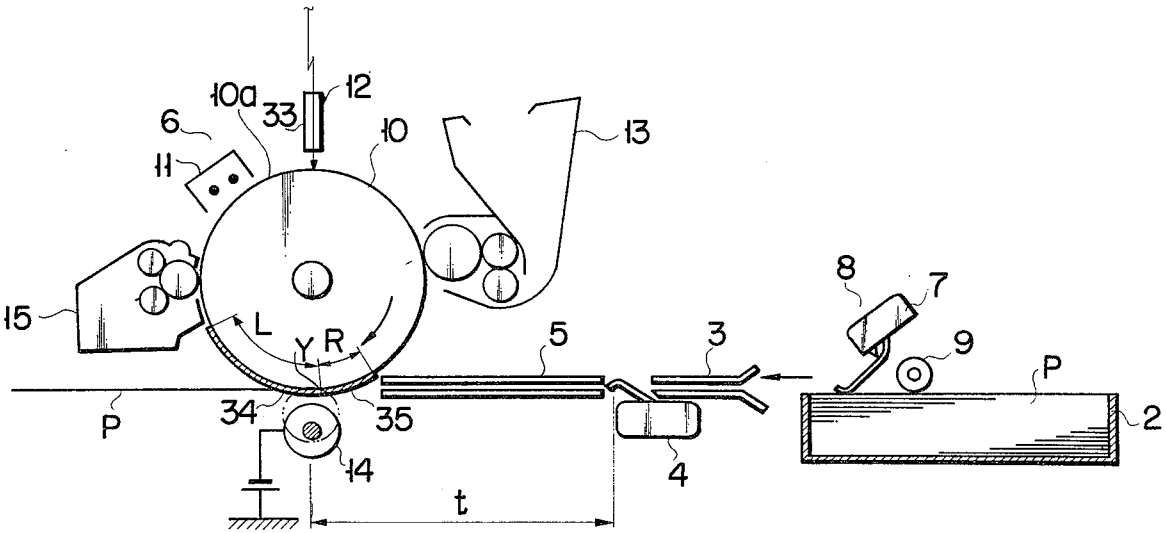
FIG. 6 is a side view for illustrating a different operation state from that shown in FIG. 5.

The solenoid 23 is magnetically excited in response to the signal inputted. By the magnetic excitation, the arm 22 is rotated clockwise in FIG. 2 to separate the operation part 22*a* from the depression 25*a*. As a result, the operation part 22*a* disengages with the operation depression 25*a*. The disengagement allows the driven shaft 27 of the semirotation clutch 25 to be coupled with the drive shaft 26. The drive force of the drive shaft 26 is transmitted to the driven shaft 27 and the cam plates 29, so that the cam plates 29 start to rotate. Immediately after the clutch body starts to rotate, the solenoid 23 is deenergized to allow the operation part 22*a* to contact with the peripheral surface of the clutch body. Then, when the cam surface closest to the eccentric shaft reaches the top, the levers 18*a* and 18*b* are released to allow the transfer roller 14*a* to rotatably contact the photosensitive drum 10. Subsequently, the depression 25*a* distant from the former depression by 180° engages the operation part 22*a* again, the cam plates 29 are held at the given position. Thus, the transfer roller 14 rotatably contacts with the photosensitive drum 10 at much the same time that the leading end of the copying paper P reaches the rotatable contact portion Y, as shown in FIG. 5.

A toner image 34 of the A4 size of the length $L_A$ and the width $l_A$, for example, on the photosensitive layer 10*a* is electrostatically transferred onto the copying paper P at the contact portion Y by means of the transfer roller 14*a*.

When the trailing edge of the copying paper P is detected by the detecting switch 4, the detecting signal is inputted to the timer circuit 44, as in the case of the leading edge detection. After the time t second taken for the trailing end of the paper P to travel from the detecting portion of the paper length detecting switch 4 to reach the transfer portion Y on the photosensitive drum 10, the signal is produced from the timer circuit 44 and is applied to the solenoid 23. In response to the signal, the solenoid 23 separates the transfer roller 14 from the photosensitive layer 10*a*.

That is, the solenoid 23 is energized when it receives the input signal. Upon the energization, the arm 22 is rotated clockwise in FIG. 2 to disengage the operation part 22*a* from the depression 25*a*. Upon the disengagement, the driven shaft 27 of the semirotation clutch 25 is coupled with the drive shaft 26. The drive force of the drive shaft 26 is transmitted to the driven shaft 27 and the cam plate 29, so that those shafts 26, 27 are rotated by 180°. When the farthest cam faces of the cam plates 29 reaches the top portion, the levers 18*a* and 18*b* are rotated against the urging force of the spring 19 clockwise in the drawing, thereby separating the transfer roller 14 from the photosensitive layer 10*a*. When the depression 25*a* distant from the former depression by 180° engages again the operation part 22*a*, the cam plates 29 are held at the given position. As indicated by two dots-dash line in FIG. 2, a separation state of the transfer roller 14*a* is realized. That is, the transfer roller 14*a* is in the separation state substantially simultaneously with the arrival of the trailing end of the paper P at the transfer portion Y. In this way, only when the copying paper P passes the rotatable contact portion Y, the image is transferred to the paper P only at the length of the length $L_A$.

The paper after copied is transferred to the fixing device of the succeeding stage.

After the transfer stage, the photosensitive layer 10*a* is cleaned by the cleaner 15 and returned to a position near the charger 11.

As described above, the transfer roller 14*a* is separated from the photosensitive drum in the other mode than the transfer mode, whereby the image transfer is made on only the portion corresponding to the length of the paper P. In addition, the image transfer on only the portion corresponding to the paper width may be realized by charging only the portion of the photosensitive layer 10*a* corresponding to the paper width. This prevents the toner from sticking onto the portion exceeding the area on the photosensitive layer defined by the paper size.

Therefore, it is possible to prevent the reverse side of the paper P from being dirtied in the next transfer stage. This implies that the cleaning mechanism of the transfer roller 14 may be simplified.

It should be understood that the present invention is not limited to the above-mentioned embodiment but may be changed or modified variously within the scope and spirit of the present invention.

While the present invention detects the leading and trailing ends of the paper P by the paper length detecting switch, and controls the contact and separation of the transfer roller for the photosensitive drum, the detection of the paper ends may be performed by other suitable means. For example, the copy signal is used for detecting the leading end of the copying paper, and is properly processed by the timer circuit and the contact and separation of the transfer roller may be controlled by the control signal.

In the above embodiment, the transfer roller is rotated by using the special drive mechanism, but the roller may be rotated by the photosensitive drum, following the rotation of the drum.

Figure 7:
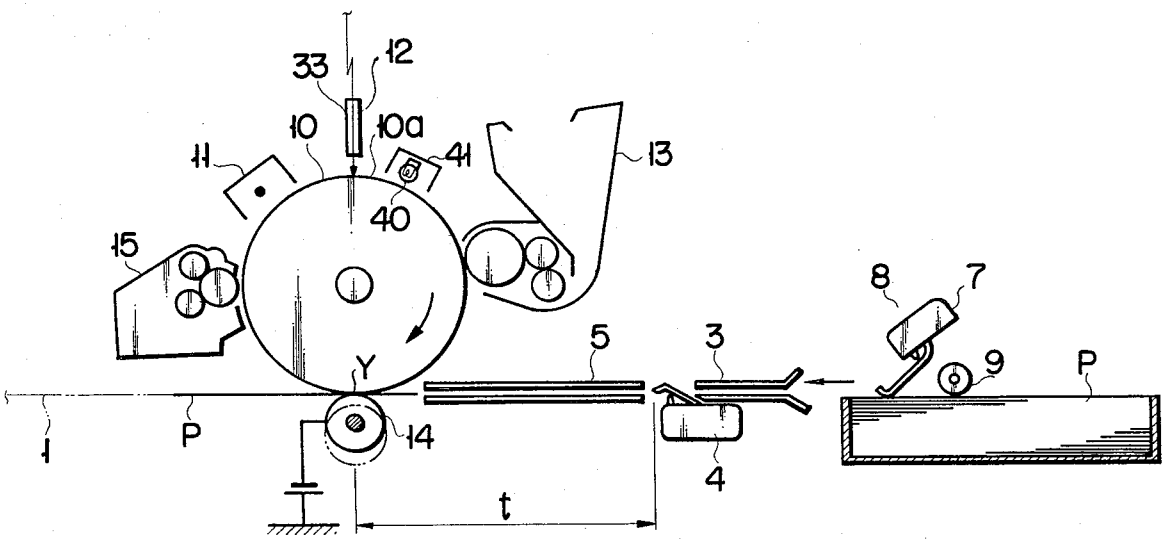
FIG. 7 is a side view of a main portion of a second embodiment of an electrostatic copying apparatus according to the present invention.
Figure 8:
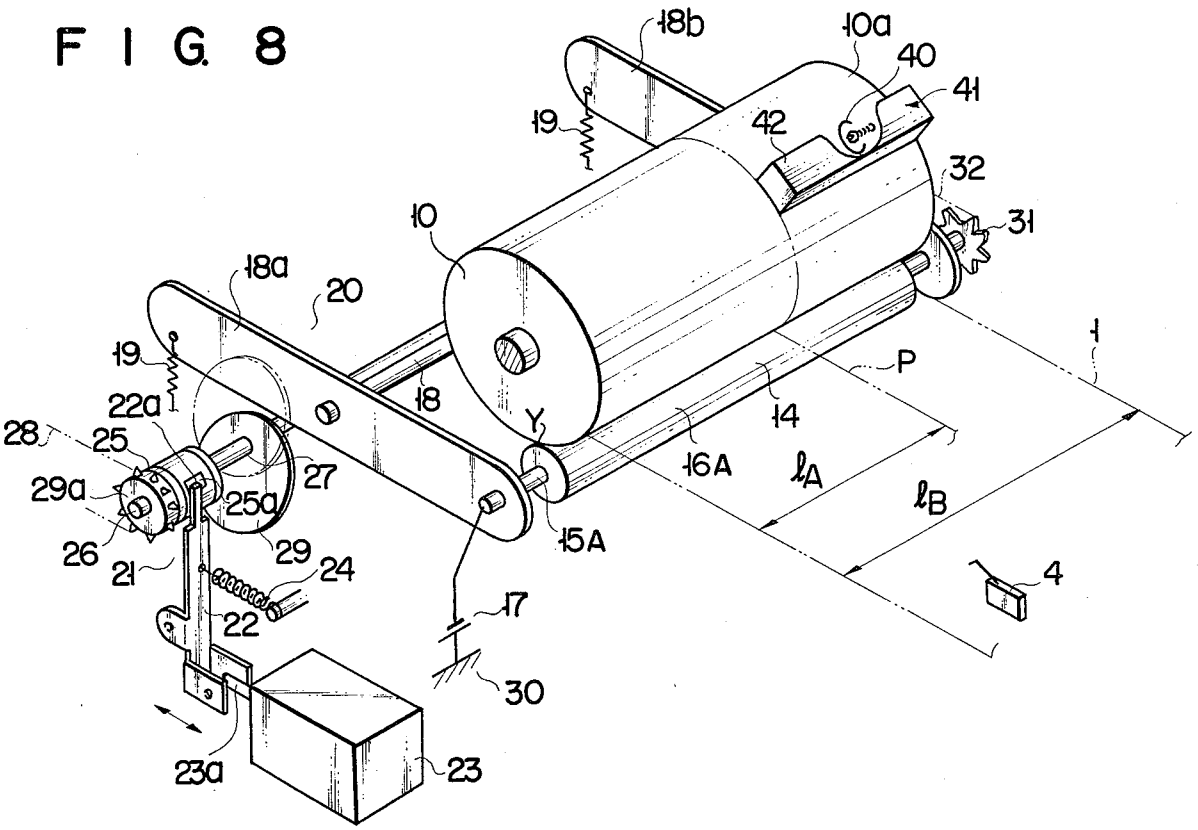
FIG. 8 is a perspective view of a transfer device used in the copying apparatus shown in FIG. 7.

A second embodiment of a transfer device according to the present invention will be described referring to FIGS. 7 and 8 hereinafter. Like and same numerals are used for designating like and same portions in the above embodiment.

In the first embodiment, the toner image formed exceeding the area defined by the paper size is precluded by using the charger with two wires with different lengths. In the second embodiment, an exposure device 41, as a charge remover, therein is disposed at a predetermined location between the exposure device 12 and the developing device 13. The exposure device 41 has an exposure lamp 40 in a main body 42. The exposure device 42 is disposed over the width $l_W$. The exposure device 41 further controls the electrical conduction of the exposure lamp 40 in accordance with the information of the detected A4 or B4 paper width from the detecting switches 7 of the detecting means 8. When the width of the A4 paper is detected, the lamp 40 is lit; while the B4 width is detected, the lamp 40 is turned off. An amount of the exposure light of the lamp 40 is so selected that when the photosensitive layer 10*a* receives light rays, the surface potential is reduced up to the bias voltage. In this way, the exposure device 41 operating according to the information of the detected paper size A4 produced from the detecting switches 7 exposes the outer periphery surface area $l_W$ of the photosensitive layer 10*a* which does not face the width length $l_A$ of the paper P of the A4 size. Through the exposure, the surface potential in the outer periphery area is below the bias voltage and effects no transfer of image.

As described above, the use of the exposure device 41 provides the effects similar to those of the first embodiment. In other words, the transfer of the image area defined by the length and width of the paper P can be performed by controlling the contact and separation of the transfer roller 14*a* for the photosensitive drum 10 and controlling the exposure of the exposure device 41. Therefore, the toner image formed on the area other than the area defined by the paper size is never stuck to the transfer roller 14. The exposure device 41 is not limited to the fixed amount type as mentioned above, but may be rotatably mounted; for example, it may be mounted movably to change the exposure location along the width direction of the photosensitive layer 10*a* according to the size of the paper copied.

Figure 9:
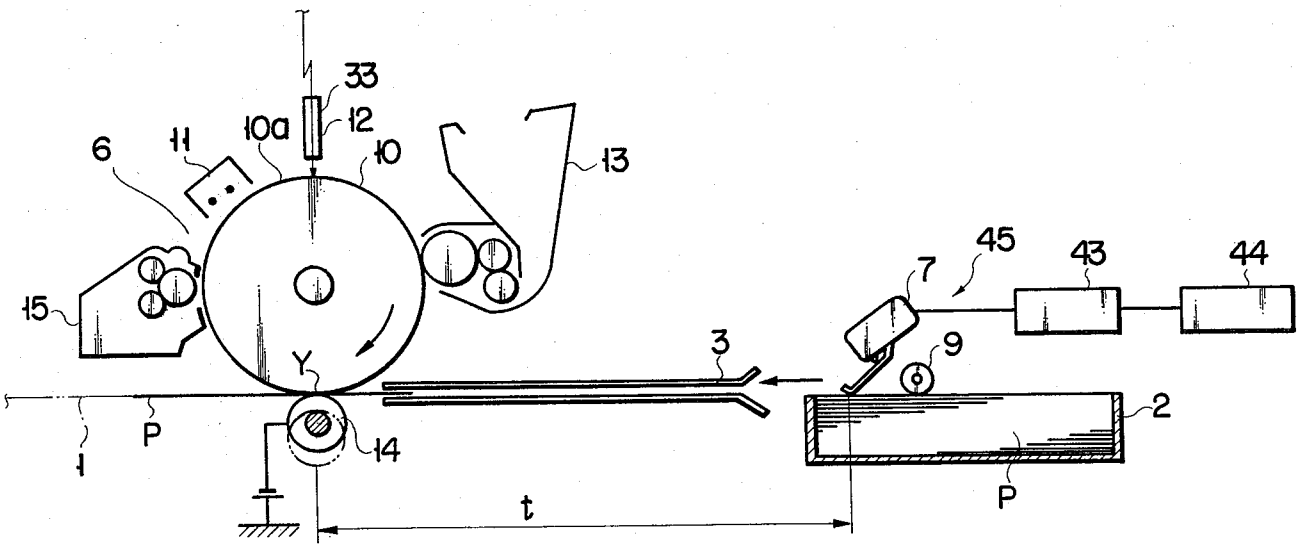
FIG. 9 is a side view of a main portion of a third embodiment of an elecrostatic copying apparatus according to the present invention.
Figure 10:
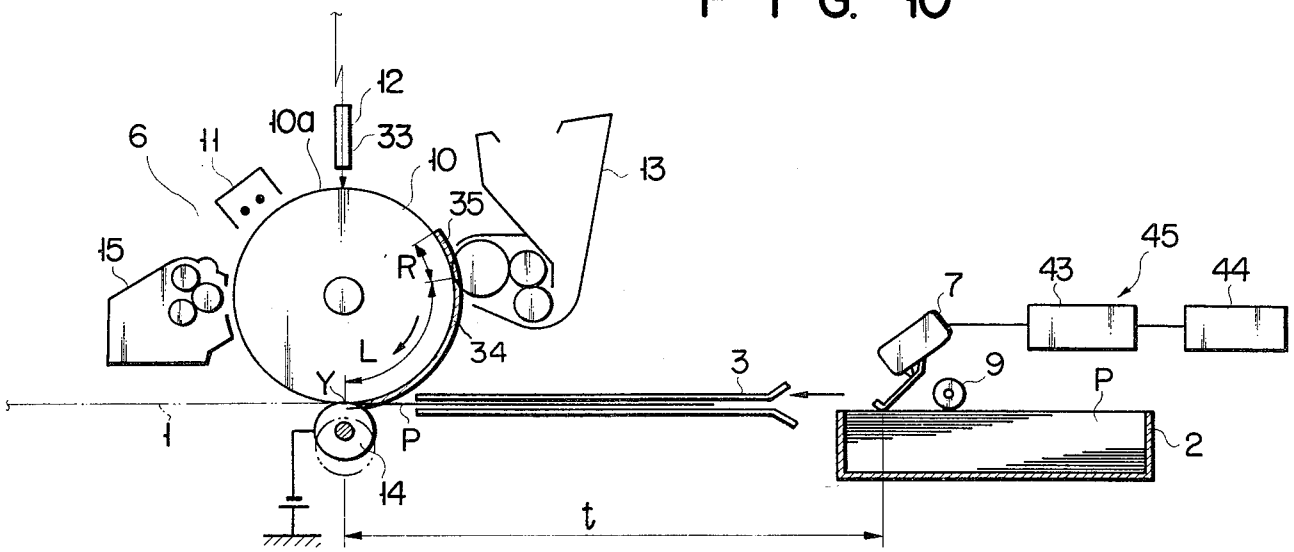
FIGS. 10 and 11 are side views of operation states of the copying apparatus which are different from that shown in FIG. 9.
Figure 11:
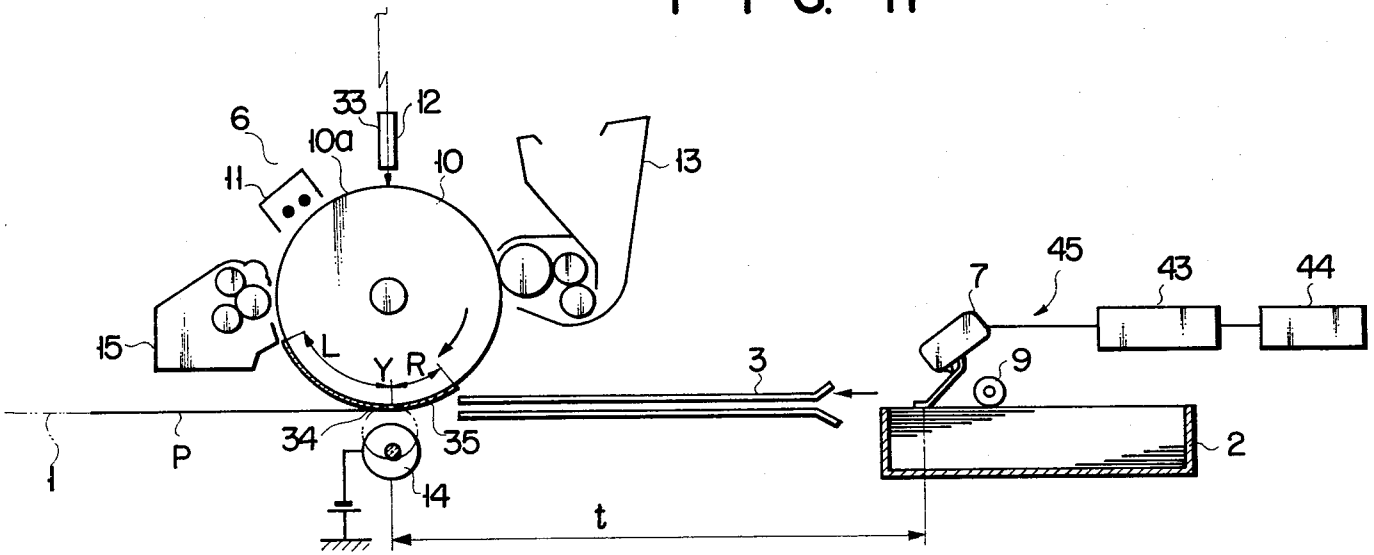

A third embodiment of a transfer device according to the present invention will be described referring to FIGS. 9 to 11. Like and same numerals are used to designate like and same portions in the first embodiment.

The output of the switches 7 is connected to a search control circuit 43 storing the information of a plurality of paper sizes such as A4, B4 and the like, and the timer circuit 44. Those constitute a size detection means 45. The size detection means 45 responds to the detected information from the switch 7 to switch the electrical conduction of the wires 16*a* and 16*b* and thus to switch the charged width on the photosensitive layer 10*a* to the area of A4 or B4. The first paper guide 3 in the third embodiment is used for directly guiding the copying paper P supplied from the paper feed cassette 2 till the rotatable contact area Y between the transfer device 14 and the photosensitive drum 10. The third embodiment does not use the paper length detecting switch 4 which is used in the first embodiment. Connected to the solenoid 23 are the detecting switches 7 through the search control circuit 43 and the timer circuit 44. When the A4 paper is detected by the detecting switches 7, the search control circuit 43 searches a signal representing the leading and trailing ends of the paper of A4. The searched signal is applied to the timer circuit 44 where it is delayed by a given time and is then applied to the solenoid 23 thereby to drive the solenoid 23. Specifically, after t taken for the leading end of the paper to travel from the detecting portion of the transfer roller 14 to the rotatable portion Y between the photosensitive drum 10 and the transfer roller 14, the leading end position signal from the timer circuit 44 is directed toward the solenoid 23, as shown in FIG. 10. The leading end position signal corresponds to the leading end detected signal of the paper P in the first embodiment. Accordingly, the solenoid 23 operates in a similar manner.

Further, after t taken for the trailing end of the paper P to travel from the detecting portion of the switch 7 to reach the contact portion Y between the photosensitive drum 10 and the transfer roller 14, the timer circuit 44 produces the trailing end position signal toward the solenoid 23. The trailing end position signal corresponds to the signal representing the detected trailing end of the transfer paper P in the first embodiment.

The size detecting means 45 receives the information of the detected paper size of A4 outputted from the detecting switches 7 to electrically energize the shorter wire 16*a* and to subsequently charge only the width of the A4 size paper on the photosensitive layer 10*a*.

In the paper feed system, the paper feed roller 9 takes out the A4 size papers sheet by sheet from the cassette 2 to transfer them along the paper transfer path 1. After time t taken for the leading end of the paper P to travel from the detecting portion of the switches 7 to reach the rotatable contact portion on the photosensitive drum 10, the timer circuit 44 produces the leading end position signal toward the solenoid 23 whereby the solenoid presses the transfer roller 14 against the photosensitive layer 10*a*.

It is evident that the size detection means 45 in the third embodiment may be used for the lamp control of the exposure device 41 in the second embodiment.

What we claim is:

1. An electrostatic copying apparatus which comprises:

an image forming body forming a toner image on the surface thereof;

a transfer device for transferring electrostatically the toner image formed on the surface of the image forming body to a copying medium; and image forming means for forming an actual image on the surface of said image forming body over a length corresponding to the width of said copying medium which extends in a direction orthogonal to a direction of the supply of said copying medium, said transfer device includes a rotatable transfer roller which faces said surface of the image forming body for selectively transferring at least two different sizes of said copying medium, a drive means for moving said transfer roller to contact with the image forming body for such a period as to feed the copying medium for a distance equal to the length thereof in the feeding direction while keeping the copying medium in contact with said image forming body, and detecting means for detecting the length extending in the width direction of said copying medium supplied to produce a signal representative of the detected width, said image forming means includes a charger disposed facing the surface of said image forming body on which an image is formed, in said width direction, which responds to the detection signal from said detecting means to charge said image forming body over the length corresponding to the width of said copying medium, said charger is provided with at least two charging wires with the lengths corresponding to the widths of said copying mediums supplied and said charging wires selectively effect corona discharge in response to the output signal from said detecting means.

* * * * *